United States Patent [19]

Kaplan

[11] 3,935,931

[45] Feb. 3, 1976

[54] KNOCKED-DOWN TRUNK

[76] Inventor: Arnold Kaplan, 1319 Auerback Ave., Hewlett Harbor, N.Y. 13654

[22] Filed: Aug. 15, 1974

[21] Appl. No.: 497,552

[52] U.S. Cl. ..... 190/19; 190/21; 217/65; 220/4 F; 220/7

[51] Int. Cl.[2] ..... A45C 5/00

[58] Field of Search ..... 190/19, 21; 220/4 F, 4 R, 220/6, 7, 80; 217/65, 69

[56] References Cited

UNITED STATES PATENTS

| | | | |
|---|---|---|---|
| 2,161,072 | 6/1939 | McKenney | 217/69 |
| 3,311,203 | 3/1967 | Pickard | 190/19 |
| 3,352,390 | 11/1967 | Zalkind | 150/1.6 |
| 3,635,368 | 1/1972 | Winsor | 220/6 |
| 3,687,325 | 8/1972 | Simons | 220/4 F |
| 3,692,204 | 9/1972 | Provi et al. | 220/4 F |
| 3,727,785 | 4/1973 | Lutz | 220/4 F |
| 3,809,278 | 5/1974 | Csumrik | 220/4 F |
| 3,814,220 | 6/1974 | Brody | 190/19 |

*Primary Examiner*—William Price
*Assistant Examiner*—Bruce H. Bernstein
*Attorney, Agent, or Firm*—Leonard H. King

[57] ABSTRACT

The novel, knocked-down storage trunk comprising the present invention includes two rigid, molded plastic shells and pairs of side and end walls. In the assembled condition a first pair of lower, inner and outer, concentric clamp rings are used to secure the lower edge of the side and end walls to the lower shell. A second, upper pair of inner and outer concentric clamp rings are secured to the upper edges of the side and end walls. Mating inner and outer vertical corner members are secured to each other and are captured in the upper and lower pairs of concentric clamp rings. The upper shell is hingedly secured to the rear side wall and conventional locks extend between and serve to couple the upper shell and the front side wall. In the knocked-down condition the upper shell nests within the lower shell and the lower shell is seated within the lower concentric pair of clamp rings. The side and end walls may be loosely placed within either of the upper or lower shells so that the carton that is required to ship the storage trunk in the knocked-down condition is substantially smaller in volume than a carton that would be required if the trunk were of the conventional type that could not be knocked down. The clamp rings may be formed, such as by an extrusion process, with channels for receiving welts or ribs that are formed integrally with the longitudinal edge portions of the side and end walls for gripping the side and end walls in the assembled condition.

The aforementioned Abstract is neither intended to define the invention of the application which, of course, is measured by the claims, nor is it intended to be limiting as to the scope of the invention in any way.

19 Claims, 14 Drawing Figures

KNOCKED-DOWN TRUNK

BACKGROUND OF THE INVENTION

1. Field of the Invention

This invention relates generally to storage trunks or the like and more particularly to a storage trunk that may be packaged and shipped and/or stored in the knocked-down condition.

2. Description of the Prior Art

For reasons which will become apparent from the following description, there has been a long-standing need for a rigid trunk which can be maintained in inventory and which can also be shipped and subsequently stored in a knocked-down condition. Concurrently there is an equally great need for a knocked-down storage trunk that may be readily assembled with only a minimum of skill and with the simplest of tools. The need for a knocked-down storage trunk having the above-noted characteristics may be most readily appreciated when it is realized that in many instances shipping costs are based on the volume of the material and not necessarily the weight. Since in the erected condition a trunk occupies a substantial volume, the shipping costs are unnecessarily high. It will be further appreciated that in storing a fully erected trunk a large volume is required whereas, if the trunk were capable of being readily dismantled and assembled, storage thereof in a knocked-down condition would require substantially smaller volumes. It follows of course that the handling and manipulation of a smaller volume, knocked-down trunk will be substantially easier than a fully erected trunk. In addition to meeting the requirement of reduced volume, a knocked-down trunk must be equally as rigid as a conventional trunk in order to achieve public acceptance. That there has been a long-standing need for a knocked-down storage trunk is evidenced by the fairly large volume of issued patents that are directed to this subject matter. However, a careful study of the issued patents reveals that, in each instance, there are one or more drawbacks to the construction disclosed which drawbacks overcome and negate any advantages that accrue to the patented construction. For example, U.S. Pat. Nos. 350,883, 792,731 and 1,398,016 all disclose sectional trunk construction. In each of the aforementioned U.S. Patents a plurality of trunk sections are stacked one above the other and are suitably secured to each other by external latches or bands. While it is true that, in each of the aforementioned US Patents, the several sections can be separated from each other, it is impossible for the sections to nest one within the other to thereby provide a reduced volume of the entire trunk in the knocked-down condition as compared to the volume of the trunk in the erected condition. Furthermore, in each of the aforementioned US Patents each section is a separate entity in that the side and end wall of each section are not separable from the top and bottom walls. U.S. Pat. No. 695,149 discloses a traveling bag with the same concept of separable sections which, in a like manner, neither permits nesting of the sections nor provides a reduced total volume in the knocked-down condition.

U.S. Pat. No. 2,056,701 is another example of a prior art structure in this field. In this last mentioned patent means are provided for vertically expanding the trunk in order to increase the capacity thereof. To accomplish this a rectangular frame is provided in several sections. However, it will be appreciated, that the prior art trunk just described cannot be knocked down in order to provide a reduced volume even though the trunk is capable of assuming two different volumes. Another representative U.S. Pat. No. 1,080,056, teaches a similar concept in that, when two sections are used a trunk of a particular volume is provided but when a number of intermediate sections are added a larger volume trunk results. Neither of these last two mentioned US Patents provides the highly desirable feature of a reduced volume in the knocked-down condition.

Still other examples of the prior art are disclosed in U.S. Pat. Nos. 1,319,072 and 3,814,220. In the second of these last two mentioned patents a collapsible suitcase is disclosed which can fold to a substantially flat condition when not in use. However, the construction is relatively costly since elongated piano hinges are required on four sides thereof in order to permit the flat folding. It will be appreciated that considerable difficulties and hence an increase cost is involved in assembling piano hinges. Moreover, because of the necessity of using piano hinges considerable rigidity must be lost, regardless of any subsequent bracing that is used. For reasons which will be more apparent hereinafter, these last two examples of the prior art exhibit inherent functional limitations since the several sections thereof are permanently secured to each other. That is, these last two examples of the prior art are not capable of interchangeability of the various sections so that should one panel be damaged during handling the entire trunk may be rendered unusable.

SUMMARY OF THE INVENTION

The present invention provides an improved, knocked-down trunk that includes two free-form molded plastic shells. Reinforcing or stiffening ribs may be provided in each of the shells during the molding operation. In the knocked-down condition the two shells are arranged to nest in each other and the four panels that constitute the side and end walls may be placed loosely within one of the shells to thereby reduce the total volume of the trunk in the knocked-down condition. The side and end walls are secured to the lower shell by means of inner and outer concentric clamp rings that are secured to each other by any suitable fasteners. A second set of concentric inner and outer clamp rings are secured to the opposite longitudinal edges of the side and end walls in order to secure them to each other. Inner and outer corner braces are also provided and are secured to each other by the conventional fasteners. The inner and outer corner braces are also retained by the upper and lower sets of concentric inner and outer clamp rings. The upper shell is hinged to one of the two side walls and locks are provided for coupling the opposite side wall to the upper shell.

In one embodiment of the invention the upper and lower concentric clamp rings are secured to the side and end walls and to the lower shell by means of nuts that are captured in the concentric clamp rings and by fasteners that mate therewith. In this first embodiment the screws pass through suitably aligned holes in the side and end walls as well as in the concentric clamp rings in the lower shell. In an alternative embodiment of the present invention the side and end walls may be captured in channels formed integrally with the concentric clamp rings by means of ribs that are either formed integrally with the side walls or by means of welts that are secured thereto. If desired, the end walls may have the inner corner braces secured permanently thereto by means of rivets with the captive nut being positioned on the inner corner braces. Alternatively, either the side or end walls may have integrally molded corners.

Accordingly, it is an object of the present invention to provide an improved knocked-down trunk or the like that occupies a substantially smaller volume in the knocked-down condition than in the erected condition.

Another object of the present invention is to provide an improved knocked-down trunk, as described above, that includes molded plastic upper and lower shells, a pair of side walls and a pair of end walls and ring means for clamping the side and end walls to each other and to the lower shell.

A further object of the present invention is to provide an improved knocked-down trunk, as described above, wherein one of the two shells nests within the other in knocked-down condition and the remaining portions of the trunk fit within the total volume defined by the two nested shells.

These and other objects, features and advantages of the invention will, in part, be pointed out with particularity, and will, in part, become obvious from the following more detailed description of the invention, taken in conjunction with the accompanying drawing, which forms an intergral part thereof.

BRIEF DESCRIPTION OF THE DRAWING

In the various figures of the drawing, like reference characters designate like parts. In the drawing.

DESCRIPTION OF THE PREFERRED EMBODIMENT

Figure 1:
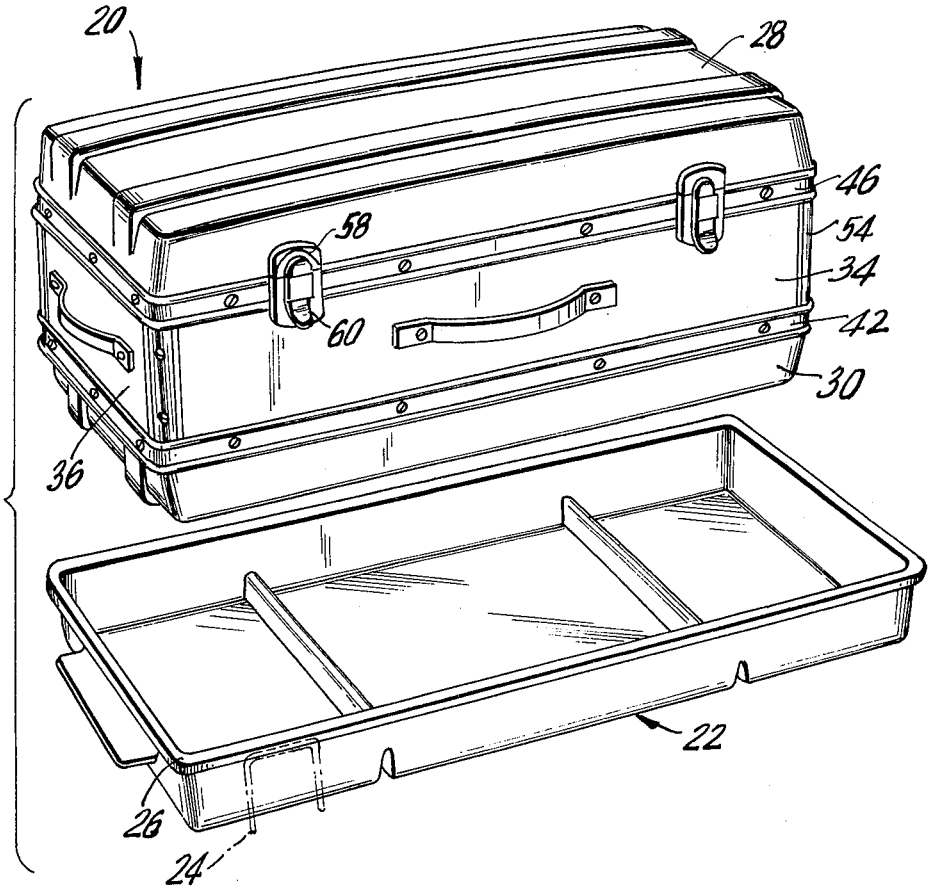
FIG. 1 is a perspective view illustrating one embodiment of the knocked-down trunk comprising the present invention, together with a tray that is adapted to be positioned therein.

Referring first to FIG. 1 there is shown a trunk 20 which constitutes the present invention. If desired, a tray 22, which is also shown in FIG. 1, may be positioned within the trunk 20. The tray 22 is supported on a plurality of clips 24 which are shown in FIG. 1 and which engage a downwardly curved peripheral lip 26 that extends about the upper edge of the tray 22.

Figure 2:
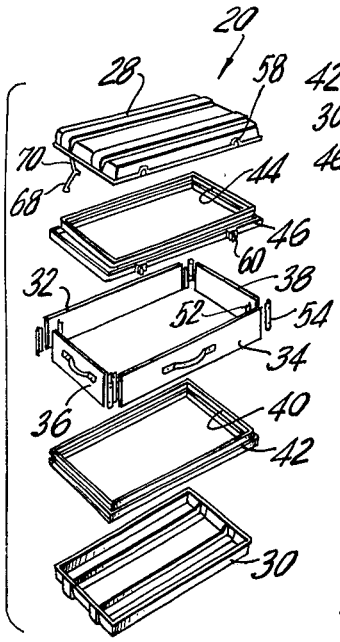
FIG. 2 is an exploded, perspective view illustratinig the various components of one embodiment of the knocked-down trunk comprising this invention.

Turning now to FIG. 2 it will be seen that the trunk 20 is comprised of upper and lower shells 28 and 30, respectively, as well as two opposed side walls 32 and 34 and two opposed end walls 36 and 38. In a manner to be described more fully hereinafter, a lower pair of inner and outer concentric clamp rings 40 and 42, respectively, are used to secure the lower, marginal edge of each of the walls 32, 34, 36 and 38 to the lower shell 30. Similarly, an upper pair of inner and outer concentric clamp rings 44 and 46, respectively, are used to secure the upper longitudinal edges of the side and end walls 32, 34, 36 and 38.

As shown in FIGS. 4–7 the trunk 20 is assembled by first placing the inner and outer lower concentric clamp rings 40 and 42 about the upper marginal edge of the lower shell 30. At this time it should be noted that the inner and outer, upper and lower concentric clamp rings 40, 42 and 44, 46 may be formed as extruded aluminum channels which will be described more fully hereinafter in connection with subsequent embodiments. In any event, after the corners of the clamp rings are formed the abutting ends thereof are secured to each other, by means of suitable fasteners and clip members, such as designated by the reference character 50 in FIG. 4. As will be seen in the drawings, a space is provided between opposite pairs of clamp rings 40, 42 and 44, 46 for receiving the longitudinal edges of the side and end walls 32, 34, 36 and 38 as well as the upper longitudinal edge of the lower shell 30. After the side and end walls 32, 34, 36 and 38 are secured to the lower shell 30, four pairs of inner and outer corner braces 52 and 54, respectively, are secured to each other by means of suitable fasteners, such as screws and captive nuts, such as described hereinabove. It should be noted that the lower end of the inner and outer corner braces 52 and 54 are received in suitably-shaped notches in the upper and lower clamp rings 40 and 42. Using preformed, aligned holes, the upper, inner and outer concentric clamp rings 44 and 46 are then secured to the side and end walls 32, 34, 36 and 38 by means of suitable fasteners, such as screws and captive nuts. The upper, concentric clamp rings 44 and 46 are also provided with notches for receiving the upper end of each of the inner and outer corner braces 52 and 54.

The upper shell 28, which may be provided with an integral, metallic rim 56, is then seated on the upper concentric clamp rings 44 and 46. It should be noted at this time that the upper shell 56 has permanently secured thereto a pair of lock sections 58 which mate with lock sections 60 that are rigidly secured to the side wall 34. Hinges 62 which are permanently secured to the upper shell 28 by means of rivets 64 are then secured to the side wall 32 by means of screws 66. In a like manner, a pair of stays, which are comprised of links 68 and 70 that are coupled to each other by a pivot pin 72, are permanently mounted on the upper shell 28 and are secured to the end walls 36 and 38 by means of screws 74 and nuts 76.

Figure 3:
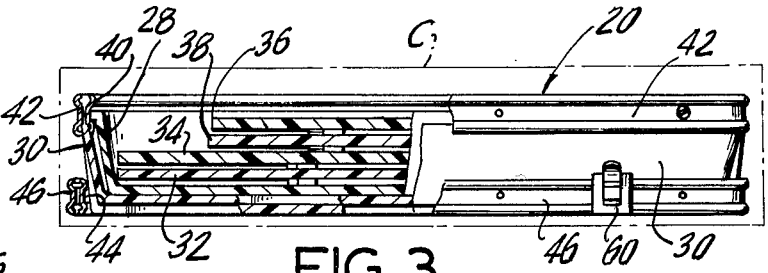
FIG. 3 is a schematic elevational view, partially broken away, illustrating the trunk of this invention in the knocked-down condition and positioned within a carton which is shown in phantom outline.

As shown in FIG. 3 the trunk 20 comprising this invention can be packaged in the knocked-down condition in a carton C which is shown in phantom outline and which is of considerably smaller volume than would be required for the same trunk in the fully erected condition. For example, a trunk having the dimensions of 30 ½ by 16 by 13 in the erected condition would have dimensions of 30 ½ by 16 by 5 ½ in the knocked-down condition. Of course other trunks having different dimensions, both larger and smaller, may be made by the teachings of this invention. It will be seen in FIG. 3 that the upper shell 28 is inverted and nests within the lower shell 30. The side and end walls 32, 34, 36 and 38 are placed loosely within one of the shells. For convenience in shipping, the lower concentric clamp rings 40 and 42 may be loosely secured by means of a single screw to the lower shell 30 while the upper concentric clamp rings 44 and 46 may be positioned about the tapered sides of the lower shell 30. Since both the upper and lower shells 28 and 30 have tapered sides they may be nested one within the other.

Figure 4:
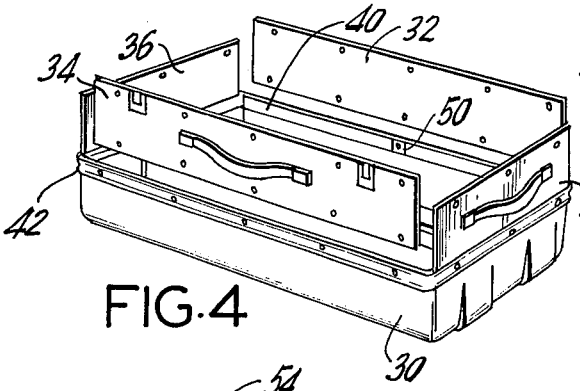
FIGS. 4–7 illustrate in exploded, perspective form several of the steps required for assembling the various components of the knocked-down trunk comprising this invention.
Figure 6:
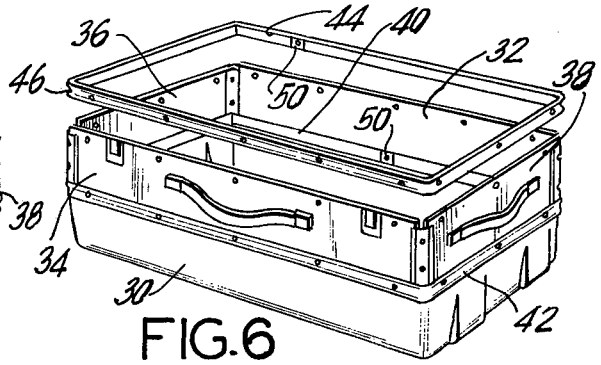
Figure 5:
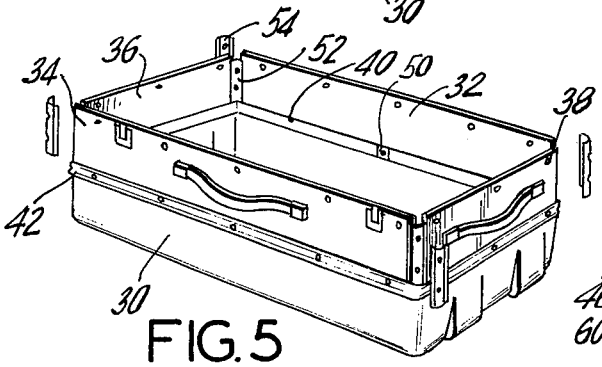
Figure 7:
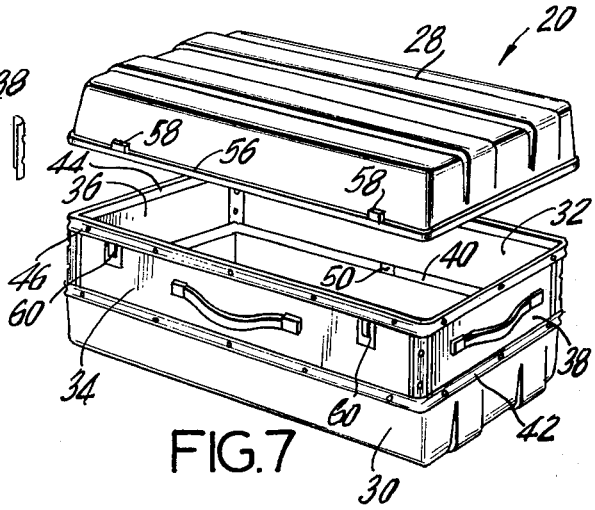
Figure 8:
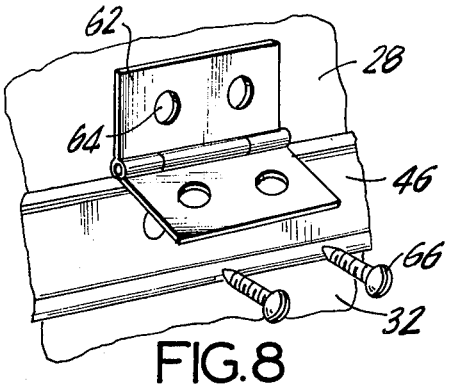
FIG. 8 is a fragmentary, perspective view illustrating the step of securing one of the hinges required by the present invention.
Figure 9:
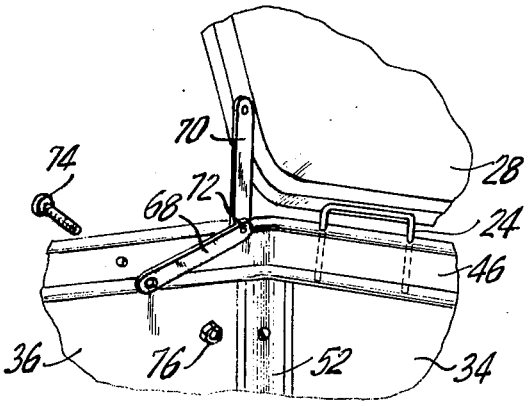
FIG. 9 is a fragmentary, exploded view illustrating the method of assembling the stay linkages.
Figure 10:
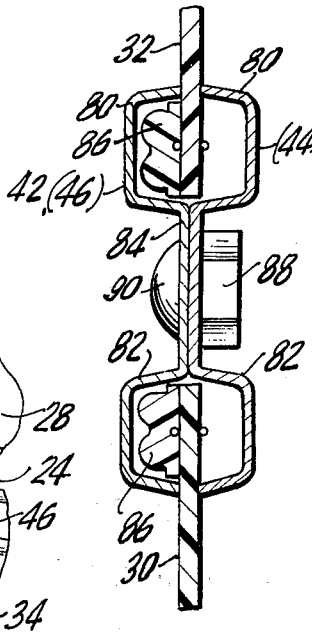
FIGS. 10 and 11 are fragmentary elevational views, in section, illustrating alternative means for securing the side and end walls and the lower shell to the inner and outer concentric clamp rings.
Figure 11:
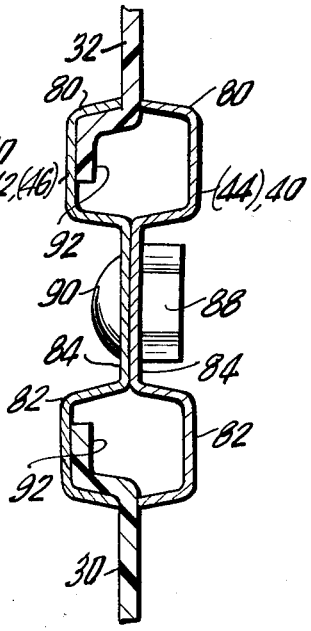

Typical construction for the upper and lower clamp rings 40, 42, and 44, 46 is shown in FIG. 10 and in FIG. 11. Alternative means for securing any of the side and end walls 32, 34, 36 and 38 as well as the upper and lower shells 28 and 30 to the clamp rings 40, 42, 44 and 46 are also shown in FIG. 10 and in FIG. 11, as well as in FIG. 12.

Referring first to FIG. 10 it will be seen that the inner and outer, lower concentric clamp rings 40 and 42 (as well as the inner and outer upper concentric clamp rings 44 and 46) are each defined by a pair of longitudinally extending parallel channels 80 and 82 which are connected by a central web 84. In the FIG. 10 embodiment an elongated welt 86 is secured to the longitudinal edge of the side wall 32 and is positioned within the channel 80. The nut 88 is secured to one of the webs 84 and the fastener 90 extends through the other web 84 and mates with the nut 88. It is understood that the welt 86 is applied to the upper and lower longitudinal edges of the side and end walls 32, 34, 36 and 38 in order to prevent movement thereof in a direction perpendicular to the longitudinal axis of the channel 80. Similar welts 86 may also be applied to the upper longitudinal edge of the lower shell 30.

Alternatively the upper and lower edges of the side and end walls 32, 34, 36 and 38, as well as the upper longitudinal edge of the lower shell 30, may be provided with an off-set lip 92 that is received in the channels 80 and 82, such as shown in FIG. 11. This alternative construction will also prevent movement of the side and end walls 32, 34, 36 and 38 in a direction perpendicular to the longitudinal edges of the channels 80 and 82.

Figure 12:
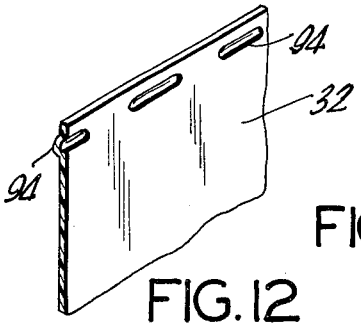
FIG. 12 is a fragmentary, perspective view illustrating an alternative construction for retaining the side and end walls and the lower shell in the concentric clamp rings.

In the embodiment shown in FIG. 12 the side and end walls 32, 34, 36 and 38 are provided with integrally molded or otherwise suitably formed ribs 94 that are adapted to be positioned within the channels 80 and 82 as described above. This last form of construction also prevents movement of the side and end walls 32, 34, 36 and 38, as well as the lower shell 30, in a direction perpendicular to the longitudinal axis of the channels 80 and 82.

Figures 13, 14:
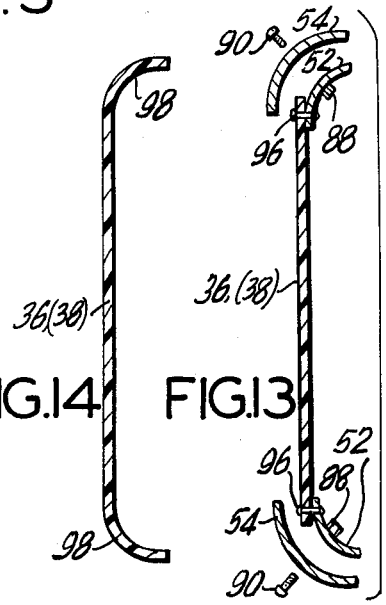
FIGS. 13 and 14 are fragmentary sectional plan views illustrating alternative embodiments for the corner configuration of either the side or end walls of the knocked-down trunk comprising this invention.

In FIGS. 13 and 14 there are shown alternative configurations for the corners of the side and end walls 32, 34, 36 and 38. In the FIG. 13 construction, the inner corner brace 52 is permanently secured to the end wall sections 36 and 38 by means of rivets 96. The captive nut 88 is secured to the inner corner brace 52 in a conventional manner, as shown and described in connection with the previous embodiments. In the FIG. 14 embodiment the inner and outer corner braces 52 and 54 are dispensed with and molded corner portions 98 are formed integrally with the end walls 36 and 38. In this last mentioned embodiment the side walls 32 and 34 abut the molded corners 98.

From the foregoing it will be evident that an improved knocked-down trunk has been provided, which trunk occupies as substantially smaller volume in the knocked-down condition than in the erected condition. The several components of the trunk comprising this invention may be easily assembled and disassembled with a minimum of skill and with only the simplest tools. The molded plastic construction with the integrally formed stiffening ribs and corner braces provides for an extremely rigid, yet light-weight trunk. The provision of inner and outer clamp rings permit compact packaging and simplified assembly.

There has been disclosed heretofore the best embodiments of the invention presently contemplated. However, it is to be understood that various changes and modifications may be made thereto without departing from the spirit of the invention.

What I claim as new and desire to secure by the Letter Patent is:

1. A trunk adapted to be erected from a knocked-down condition said trunk comprising:

a. a first, lower shell;

b. a second, uppershell that is at least partially nestable within said first, lower shell in the knocked-down condition of said trunk;

c. a pair of side walls and a pair of end walls that are loose in the knocked-down condition and which are constructed so that they are adapted to be positioned within one of said shells in the knocked-down condition of said trunk;

d. first removable clamping means for securing said side and said end walls to said first, lower shell, said first clamping means comprising inner and outer, ringshaped members to each other after said side and said end walls are positioned therebetween;

e. second removable clamping means for joining said side and said end walls to each other; and f. hinge means for coupling said second, upper shell to one of said side walls.

2. The trunk according the claim 1 wherein said side and said end walls include means for connecting said fastener means when said trunk is fully erected.

3. The trunk according the claim 1 wherein said ringshaped members include elongated channels therein and wherein said fastener means further include elongated projections on said first, lower shell and said side and said end walls whereby said projections engage said channels and prevent movement of said side and said end walls in a direction perpendicular to the axis of said channels.

4. The trunk according to claim 3 wherein said elongated projection is an offset lip.

5. The trunk according to claim 3 wherein said elongated projection is an integral rib.

6. The trunk according to claim 3 wherein said elongated projection is a welt that is rigidly attached to said member that is secured by said first clamping means.

7. The trunk according to claim 1 wherein said second clamping means comprises inner and outer ring-shaped members and removable fastener means for securing said ring-shaped members to each other after said side and said end walls are positioned therebetween.

8. The trunk according to claim 7 wherein said side and said end walls included means for connecting said fastener means when said trunk is fully erected.

9. The trunk according to claim 7 wherein said ring-shaped members include elongated channels therein and wherein said fastener means further include elongated projections on said first, lower shell and said side and said end walls whereby said projections engage said channels and prevent movement of said side and said end walls in a direction perpendicular to the axis of said channels.

10. The trunk according to claim 9 wherein said elongated projection is an offset lip.

11. The trunk according to claim 9 wherein said elongated projection is an integral rib.

12. The trunk according to claim 9 wherein said elongated projection is a welt that is rigidly attached to said member that is secured by said first clamping means.

13. The trunk according to claim 1 wherein there is further included corner brace means at the juncture of each said side and said end wall.

14. The trunk according to claim 13 wherein said corner brace means comprises inner and outer channels and fastener means for securing said inner and said outer channels to each other.

15. The trunk according to claim 13 wherein said corner brace means extend between and are secured at the end thereof by said first and second clamping means.

16. The trunk according to claim 1 wherein there is further included linkage means extending between said second shell and said side walls, said linkage means being adapted to maintain said trunk in the open condition when fully erected.

17. The trunk according to claim 1 wherein there is further included a removable tray and means for supporting said tray internally of said trunk when said trunk is fully erected.

18. The trunk according to claim 1 wherein there is further included lock means for securing said second, upper shell in the closed condition when said trunk is fully erected.

19. The trunk according to claim 1 wherein at least one of said pair of end walls is at least partially curved at the end thereof to define the corners of said trunk in the erected condition.

* * * * *

UNITED STATES PATENT OFFICE

CERTIFICATE OF CORRECTION

PATENT NO. : 3,935,931

DATED : February 3, 1976

INVENTOR(S) : KNOCKED-DOWN TRUNK

It is certified that error appears in the above-identified patent and that said Letters Patent are hereby corrected as shown below:

In the Claims:

Claim 2, line 1 change "the" (second appearance) to --to--.

Claim 3, line 1 change "the" (second appearance) to --to--.

Claim 8, line 2 change "included" to --include--.

Signed and Sealed this twentieth Day of April 1976

[SEAL]

Attest:

RUTH C. MASON
*Attesting Officer*

C. MARSHALL DANN
*Commissioner of Patents and Trademarks*